US007606384B2

(12) United States Patent
Engebretson et al.

(10) Patent No.: US 7,606,384 B2
(45) **Date of Patent: *Oct. 20, 2009**

(54) SPIRAL LINE ARRAY LOUDSPEAKER

(75) Inventors: Mark E. Engebretson, Huntington Beach, CA (US); Luis F. Esparza, Chino Hills, CA (US)

(73) Assignee: QSC Audio Products, Inc., Costa Mesa, CA (US)

( * ) Notice: Subject to any disclaimer, the term of this patent is extended or adjusted under 35 U.S.C. 154(b) by 800 days.

This patent is subject to a terminal disclaimer.

(21) Appl. No.: 11/244,679

(22) Filed: Oct. 5, 2005

(65) Prior Publication Data

US 2008/0085028 A1 Apr. 10, 2008

(51) Int. Cl.
*H04R 9/06* (2006.01)
*H04R 1/20* (2006.01)

(52) U.S. Cl. ..... 381/335; 381/337; 381/343; 381/345

(58) Field of Classification Search ..... 381/335, 381/337

See application file for complete search history.

(56) References Cited

U.S. PATENT DOCUMENTS

| | | | | |
|---|---|---|---|---|
| 4,071,112 | A | 1/1978 | Keele, Jr. | |
| 4,091,891 | A | 5/1978 | Hino et al. | |
| 4,164,631 | A | 8/1979 | Garner et al. | |
| 4,344,504 | A | 8/1982 | Howze | |
| 4,390,078 | A | 6/1983 | Howze et al. | |
| 4,685,532 | A | 8/1987 | Gunness | |
| 4,845,759 | A | 7/1989 | Danley | |
| 4,945,334 | A | 7/1990 | Biersach | |
| 4,969,196 | A | 11/1990 | Nakamura | |
| 5,046,581 | A | 9/1991 | Mitchell | |
| 5,309,518 | A | 5/1994 | Ickler et al. | |
| 5,524,062 | A | 6/1996 | Oh | |
| 5,526,456 | A | 6/1996 | Heinz | |
| 5,590,214 | A | 12/1996 | Nakamura | |
| 5,602,366 | A | 2/1997 | Whelen et al. | |
| 5,750,943 | A | 5/1998 | Heinz | |
| 5,900,593 | A | 5/1999 | Adamson | |
| 6,095,279 | A | 8/2000 | Adamson | |
| 6,112,847 | A | 9/2000 | Lehman | |
| 6,394,223 | B1 | 5/2002 | Lehman | |
| 6,700,984 | B1 * | 3/2004 | Holberg et al. | 381/338 |
| 6,744,899 | B1 | 6/2004 | Grunberg | |
| 2004/0218773 | A1 * | 11/2004 | Andrews | 381/335 |

FOREIGN PATENT DOCUMENTS

| | | | |
|---|---|---|---|
| EP | 1 178 702 | A2 | 6/2002 |
| JP | 03-022795 | A | 1/1991 |

* cited by examiner

*Primary Examiner*—Brian Ensey
*Assistant Examiner*—Matthew Eason
(74) *Attorney, Agent, or Firm*—Crowell & Moring LLP

(57) ABSTRACT

A loudspeaker system consisting of a plurality of direct-radiating electro-acoustical drivers arrayed along a spiral line. The acoustical drivers may be directly coupled to an acoustical waveguide without use of adapters or a throat section. The waveguide and the acoustical drivers may thus be oriented along the spiral line so as to produce controlled vertical and horizontal angular coverage with improved phase coherence and reduced distortion. A plurality of phase plugs may be interspersed between the plurality of acoustical drivers to assist in equalizing the sound path to achieve uniform phase at the mouth of the waveguide.

31 Claims, 15 Drawing Sheets

$$R_{Line}(\alpha) = \frac{\sin\left(\frac{kl}{2}\sin\alpha\right)}{\frac{kl}{2}\sin\alpha}$$

$$R_{Curved}(\alpha) = \frac{1}{2m+1}\left|\sum_{n=-m}^{n=m}\cos\left[\frac{2\pi R}{\lambda}\cos(\alpha+n\phi)\right] + i\sum_{n=-m}^{n=m}\sin\left[\frac{2\pi R}{\lambda}\cos(\alpha+n\phi)\right]\right|$$

where: 2m+1 is the number of point sources, and $\phi$ is the angle subtended between any two adjacent point sources.

520
θ
$510_{1-N}$
520
500
Constant
Horizontal
Coverage

520
θ
θ
$510_{1-N}$
520

620
$\theta_T$
$\theta_B$
620
600
Linearly
Changing
Horizontal
Coverage

620
$\theta_T$
$\theta_B$
620

1000

Changing Horizontal Coverage

1120
$1130_{1-i}$
$1110_{1-N}$
1120
BACK
1100
Constant Horizontal Coverage w/ Vanes 1120
$1130_{1-i}$
$1110_{1-N}$
1120
FRONT 1220
1230$_{1-i}$
1210$_{1-N}$
$\theta_T$
$\theta_B$
1220
BACK
1200
Linearly Changing Horizontal Coverage w/ Vanes 1220
1230$_{1-i}$
1210$_{1-N}$
$\theta_T$
$\theta_B$
1220
FRONT

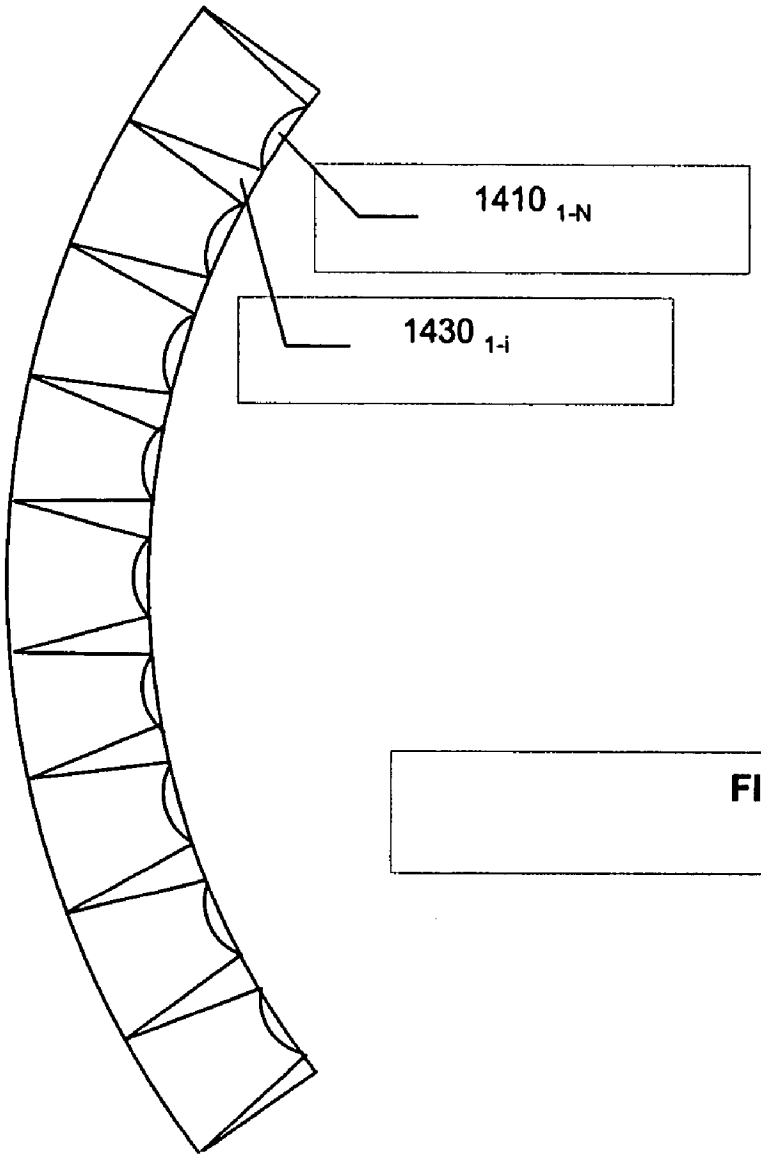
FIG. 14B (Arcuate Array)

SPIRAL LINE ARRAY LOUDSPEAKER

FIELD OF THE INVENTION

The invention relates in general to acoustic energy projection. In particular, the invention relates to spiral line array loudspeakers.

BACKGROUND OF THE INVENTION

Numerous approaches to improving acoustic energy radiation have been undertaken in the prior art. Straight line loudspeaker arrays have been used, but require complex delay, frequency or amplitude shading to be effective over a limited range of frequency coverage. Another conventional loudspeaker array is the J-array design which requires separate frequency-amplitude equalization for straight and curved portions of the array due to the abrupt discontinuity in array shape.

A third approach to designing loudspeaker arrays has been to distribute the array along an arcuate line. As described in U.S. Pat. No. 6,112,847 and U.S. Pat. No. 6,394,223, the output ports of a series of compression drivers are coupled to the inlets of corresponding throat sections. The mouths of the throat sections are then acoustically coupled to a single array wave guide that is shaped as an arc in the vertical plane. While this approach is thought to improve energy distribution along the vertical plane, it still suffers from several drawbacks, including the need for slowly expanding throat sections, which increase distortion, and create internal reflections that alter the sound due to the expansion discontinuity where the mouths of the throats join the inlet aperture of the waveguide.

Thus, there is still an unsatisfied need for a curved line array loudspeaker design which overcomes one or more of the aforementioned drawbacks.

SUMMARY OF THE INVENTION

A curved line array loudspeaker, sound radiation system and throatless waveguide system are disclosed and claimed. In one embodiment, a loudspeaker includes a plurality of electro-acoustical drivers each having a radiating axis to generate sound over a range of frequencies, wherein the electro-acoustical drivers are disposed in a geometric spiral with successive increases in angular displacement between the radiating axes forming a spiral line array.

Other embodiments are disclosed and claimed herein.

BRIEF DESCRIPTION OF THE DRAWINGS

FIGS. 14A-14B are front and cross section views of one embodiment of a curved array loudspeaker having a constant horizontal coverage and segmented by a plurality of phase plugs.

DETAILED DESCRIPTION OF THE EXEMPLARY EMBODIMENTS

According to one aspect of the invention, a plurality of electro-acoustical drivers may be arranged in a curved line array using a single waveguide. While in one embodiment the curved line array may be a spiral array, in another embodiment it may be any curved line array. One such array has all sources at a constant radial distance from an imaginary point of rotation. In contrast, lines normal to the surface of a spiral line array do not converge to a common point.

In one embodiment of the invention, the electro-acoustical drivers are physically and acoustically coupled directly to a waveguide without the use of a throat section. The waveguide and the electro-acoustical drivers may thus be oriented in line along the selected curve so as to produce the desired vertical angular coverage. In another embodiment, the electro-acoustical drivers are direct-radiating transducers.

The vertical angular coverage afforded by a curved line array corresponds to the included angle of the arc. In one embodiment, the array may be comprised of a number of identical sources tightly grouped along the length of the array, the upper portion of the array would have several elements overlapping and the radiated sound pressure in the direction of aiming would be high. In the case of a spiral array, the spiral array becomes progressively tighter as you move down its length, and the radiation axes of the sources diverge, resulting in a progressive reduction in coverage overlap and a gradual lowering of the sound pressure.

Another aspect of the invention is to provide a loudspeaker comprised of the aforementioned plurality of electro-acoustical drivers arranged in a curved line array. In one embodiment, the waveguide to which the plurality of electro-acoustical drivers are coupled provides a constant horizontal coverage across a prescribed coverage area throughout the length of the array. In another embodiment, the waveguide may be designed to provide a linearly-changing horizontal coverage so as to provide equal coverage to an essentially rectangular shaped area. It should further be appreciated that non-linearly changing waveguides designs may be used to provide coverage to areas having numerous other shapes and configurations.

In another embodiment, the waveguide may provide horizontal coverage that, although constant over the length of the array, is nonetheless offset from a centerline of the array so as to bias coverage towards one of two horizontal directions.

Another aspect of the invention is to intersperse a plurality of phase plugs between adjacent drivers to equalize the sound path lengths from the electro-acoustical drivers, maintain uniform phase between adjacent drivers at the mouth of the waveguide. In one embodiment, the plurality of phase plugs essentially prismatic frustum wedge segments extending outward from a driver mounting surface to a point no further than a mouth of the waveguide.

Figure 1:
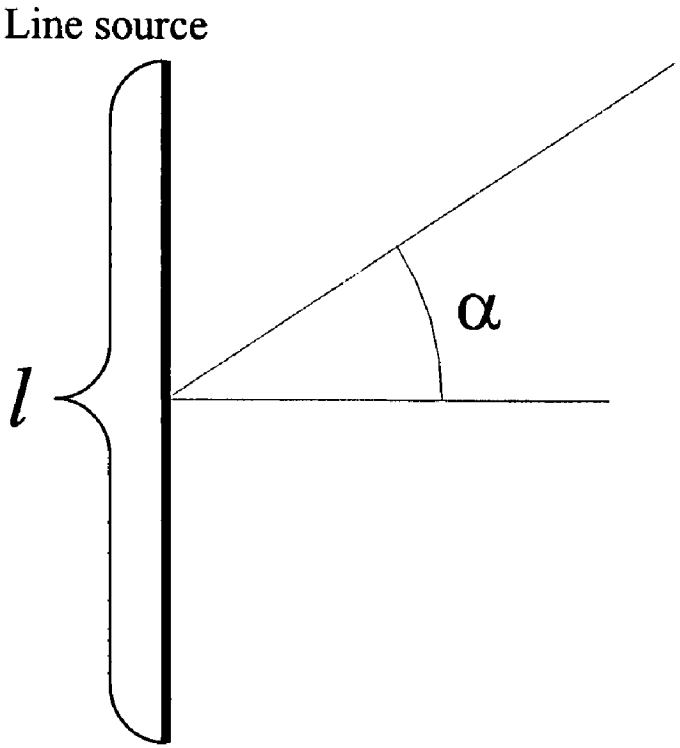
FIG. 1 depicts a mathematical description of the acoustic directivity function of a loudspeaker line array.
Figure 2:
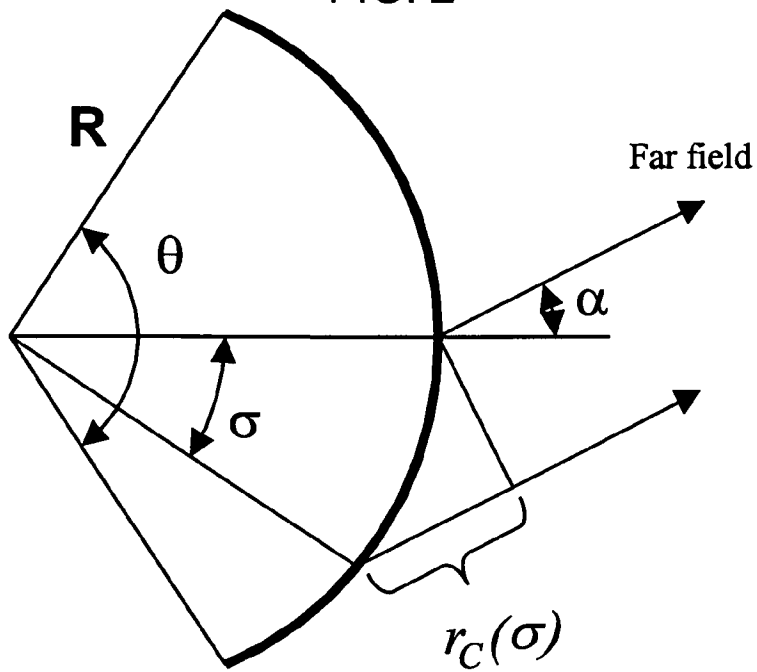
FIG. 2 depicts a curved array directivity function.

Referring now to FIG. 1, depicted is a mathematical description of the acoustic directivity function of a loudspeaker line array. In this embodiment, the line source, l, directs sound energy through an angle, α, which is the angle between a line perpendicular to the line source, l, and the distant observation point. FIG. 2, in contrast, depicts the curved array directivity function given by the following Equation 1:

$$R_{Curve}(\alpha) = \frac{1}{2m+1}\left|\sum_{K=-m}^{K=m}\cos\left[\frac{2\pi R}{\lambda}\cos(\alpha+K\theta)\right] + j\sum_{K=-m}^{K=m}\sin\left[\frac{2\pi R}{\lambda}\cos(\alpha+K\theta)\right]\right|$$

where,

α=the angle between the radius drawn through the central point and the line joining the source and the distant observation point;

R=radius of the arc;

2m+1=number of points;

θ=angle subtended by any two points at the center of the arc; and

K=index.

Figure 3:
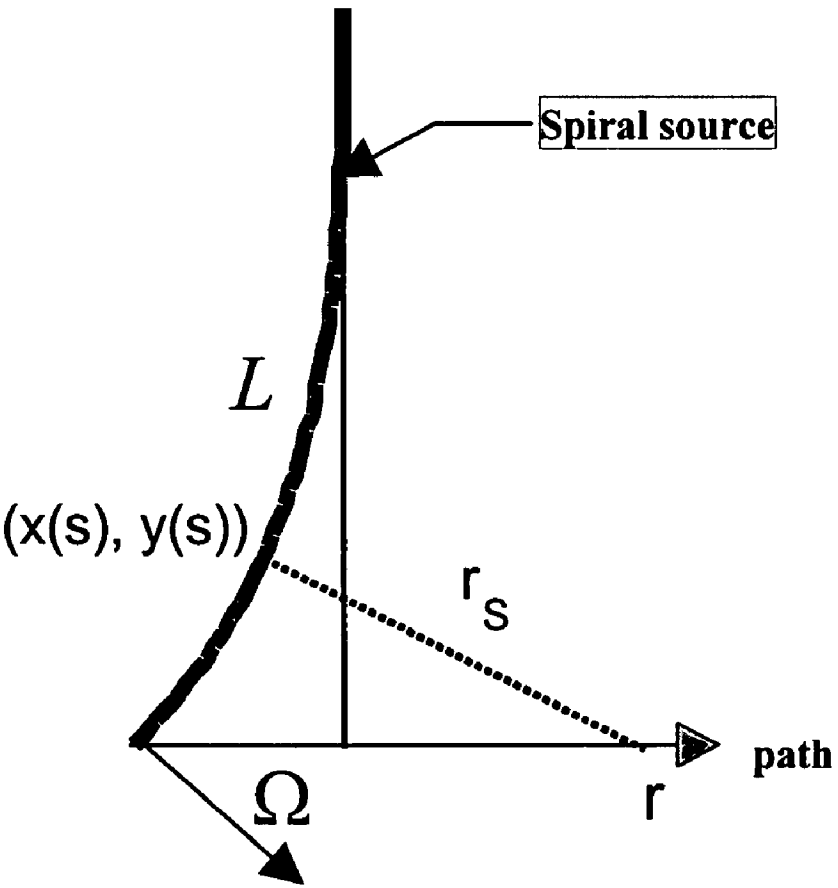
FIG. 3 depicts one embodiment of a geometric model of a spiral line array source.

FIG. 3 depicts one embodiment of a geometric model of a spiral line array source. As shown, any position along the spiral source may be given by Equations 2 and 3 below:

$$x(s) = \sum_{\eta=0}^{s} -\sin\left[\frac{1}{2}\eta(\eta+1)\Delta\psi\right]\Delta L \tag{2}$$

$$y(s) = \Delta L + \sum_{\eta=0}^{s} -\cos\left[\frac{1}{2}\eta(\eta+1)\Delta\psi\right]\Delta L \tag{3}$$

where, x(s)=position along the x-axis;

η=number of elements;

Δψ=incremental angle between elements=2Ω/M(M+1); and

L=length of the array.

Given a position {x(s), y(s)} along the spiral array, the radius along which sound energy is directed may be found using Equation 4 below:

$$r_s=\sqrt{(r-x(\sigma))^2+(y(M)-y(\sigma))^2} \tag{4}$$

where, $r_s$=relative distance at index s along the spiral;

σ=relative distance; and

M=number of elemental length segments=L/ΔL.

Figure 4:
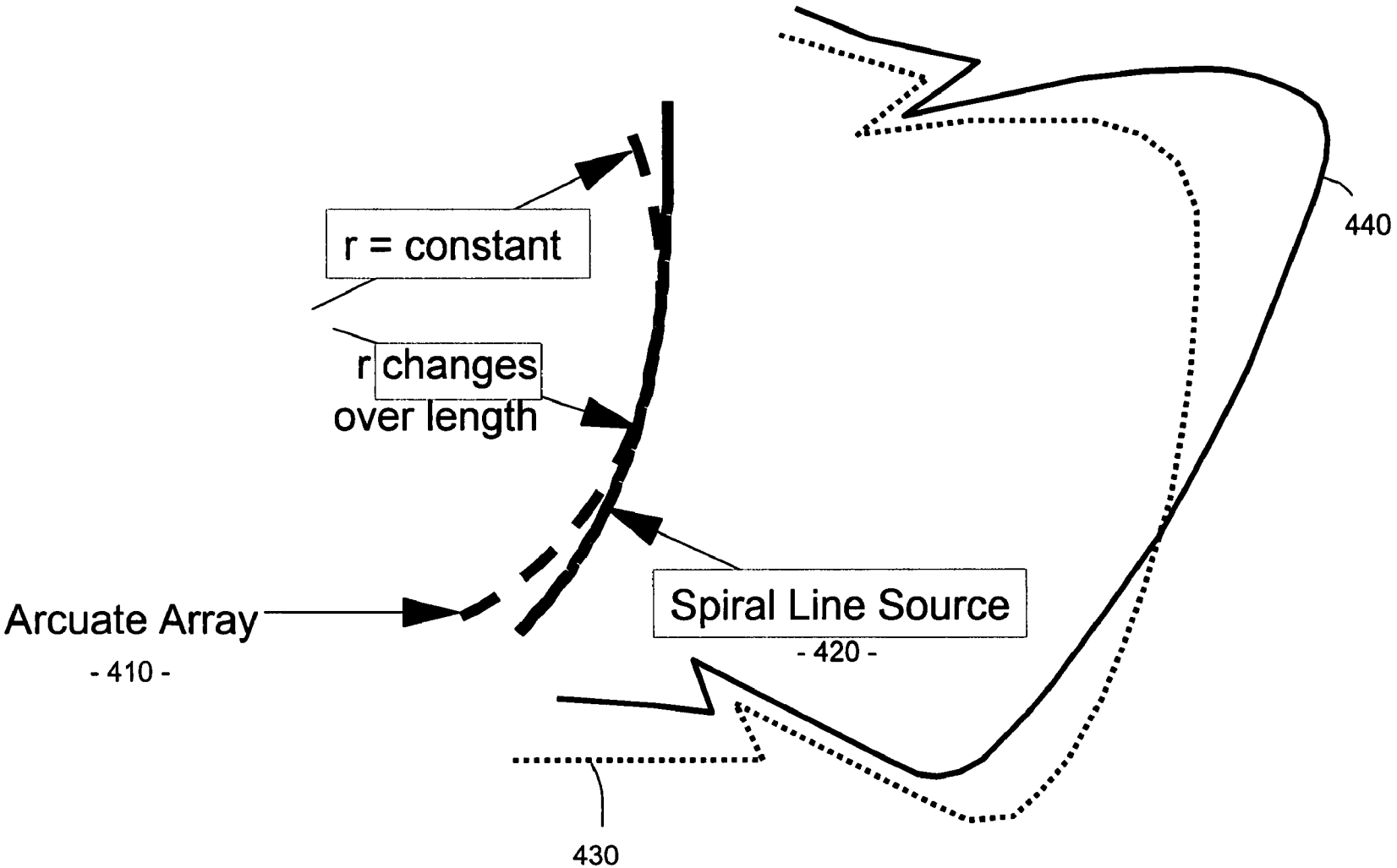
FIG. 4 depicts a comparison of the sound energy directivity of an arcuate and a spiral array, according to one embodiment.

FIG. 4 depicts one embodiment of a comparison of the sound directivity of an arcuate array and a spiral array. As shown in FIG. 4, the arcuate array 410 has all sources at a constant radial distance from an imaginary point of rotation. In contrast, the spiral line source 420 has a radius which changes along the length of the array. That is, lines normal to the surface of a spiral line array do not converge to a common point. As shown by the sound energy directivity patterns 430 and 440 in FIG. 4, the spiral line source 420 "tilts" the polar response to direct more sound energy toward the back of the coverage area, while providing less energy to the front of the coverage area. The arcuate array, on the other hand, provides a uniform polar response across the array.

Figures 5A, 5B:
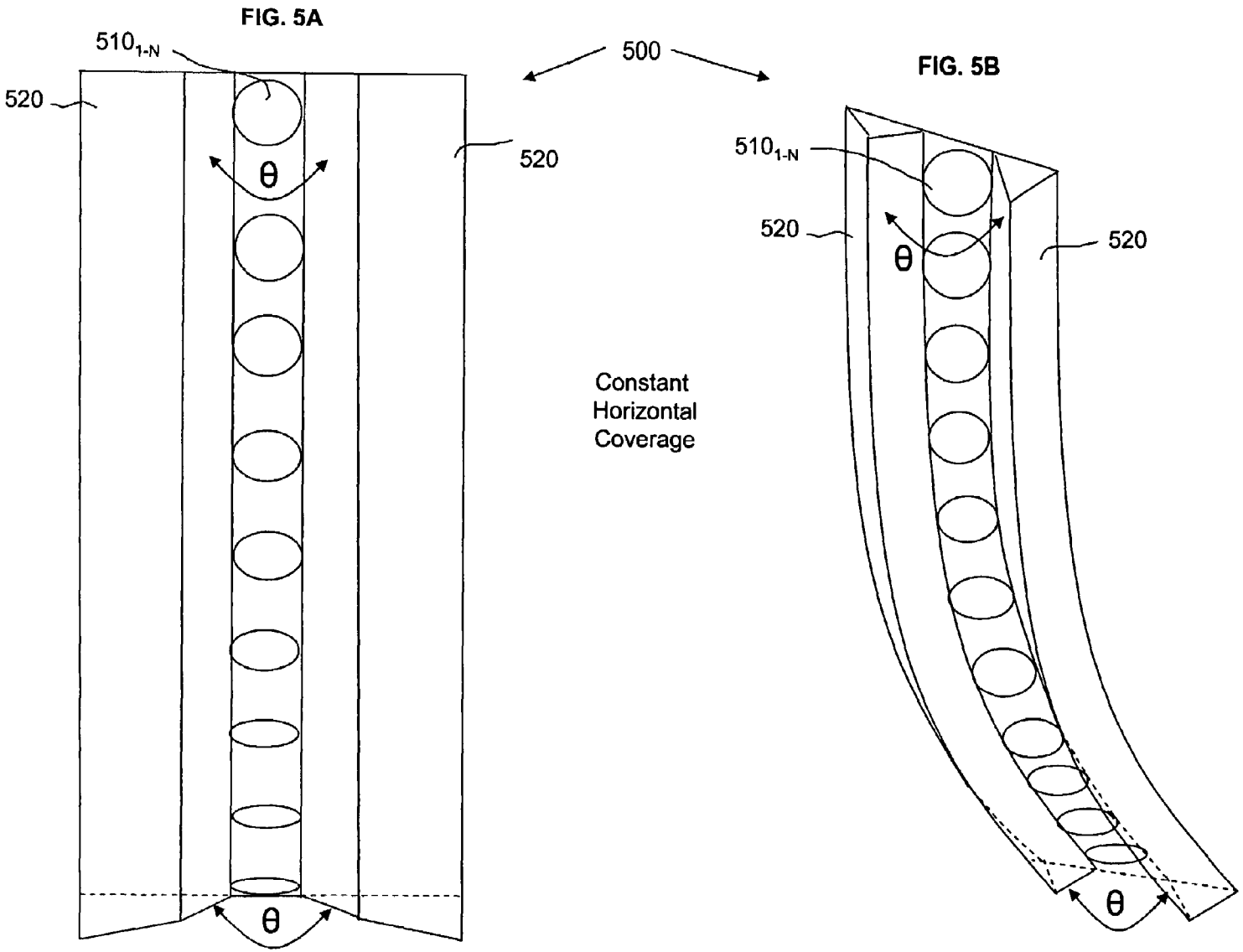
FIGS. 5A-5B depict one embodiment of a curved array loudspeaker having a constant horizontal coverage.

FIGS. 5A-5B depict one embodiment of a curved array loudspeaker 500 providing constant horizontal coverage along the length of the array. While in one embodiment, the loudspeaker 500 may be comprised of a spiral array, in another embodiment the loudspeaker 500 may be comprised of any curved array. FIG. 5A depicts a front view of the loudspeaker 500 with N drivers $\mathbf{510}_{1\text{-}N}$ running along the length of the loudspeaker 500, whereas FIG. 5B depicts a perspective view of the loudspeaker 500. It should be noted that the appearance of the drivers $\mathbf{510}_{1\text{-}N}$ changes from circular to elliptical toward the bottom of the loudspeaker when viewed from the front, since the array gradually spirals away from the field of view towards the lower portions of the array.

As will be described in more detail below, drivers $\mathbf{510}_{1\text{-}N}$ may be grouped tightly enough along the array such that the sound radiation axes at the upper portion of the array are nearly parallel to one another, resulting in overlapping coverage from the proximate drivers. This overlapping coverage provides for an increase in sound pressure for auditors seated at the further distances from the array. As the spiral becomes progressively tighter towards the bottom of the array, the sound radiation axes diverge, thereby decreasing the sound pressure relative to the top portion of the array. Since the bottom of the array is responsible for coverage of the lower positions, and since lower positions are typically closer than higher seating, the net effect is a relatively constant level of sound pressure across the distance gradient.

Continuing to refer to FIGS. 5A-5B, constant horizontal coverage is provided by waveguide 520, which spans along the left and right sides of the drivers $\mathbf{510}_{1\text{-}N}$, as depicted in FIGS. 5A-5B. In one embodiment, the angle θ between the left and right sides of waveguide 520 may vary between approximately 60 degrees and 120 degrees. It should further be appreciated that, in the embodiments of FIGS. 5A-5B, drivers $\mathbf{510}_{1\text{-}N}$ are oriented in a forward position adjacent to the waveguide 520 and are directly connected to the waveguide. In one embodiment, the absence of a connecting throat section advantages reduced distortion, improved sound quality coherence and reduced complexity of design.

Figures 6A, 6B:
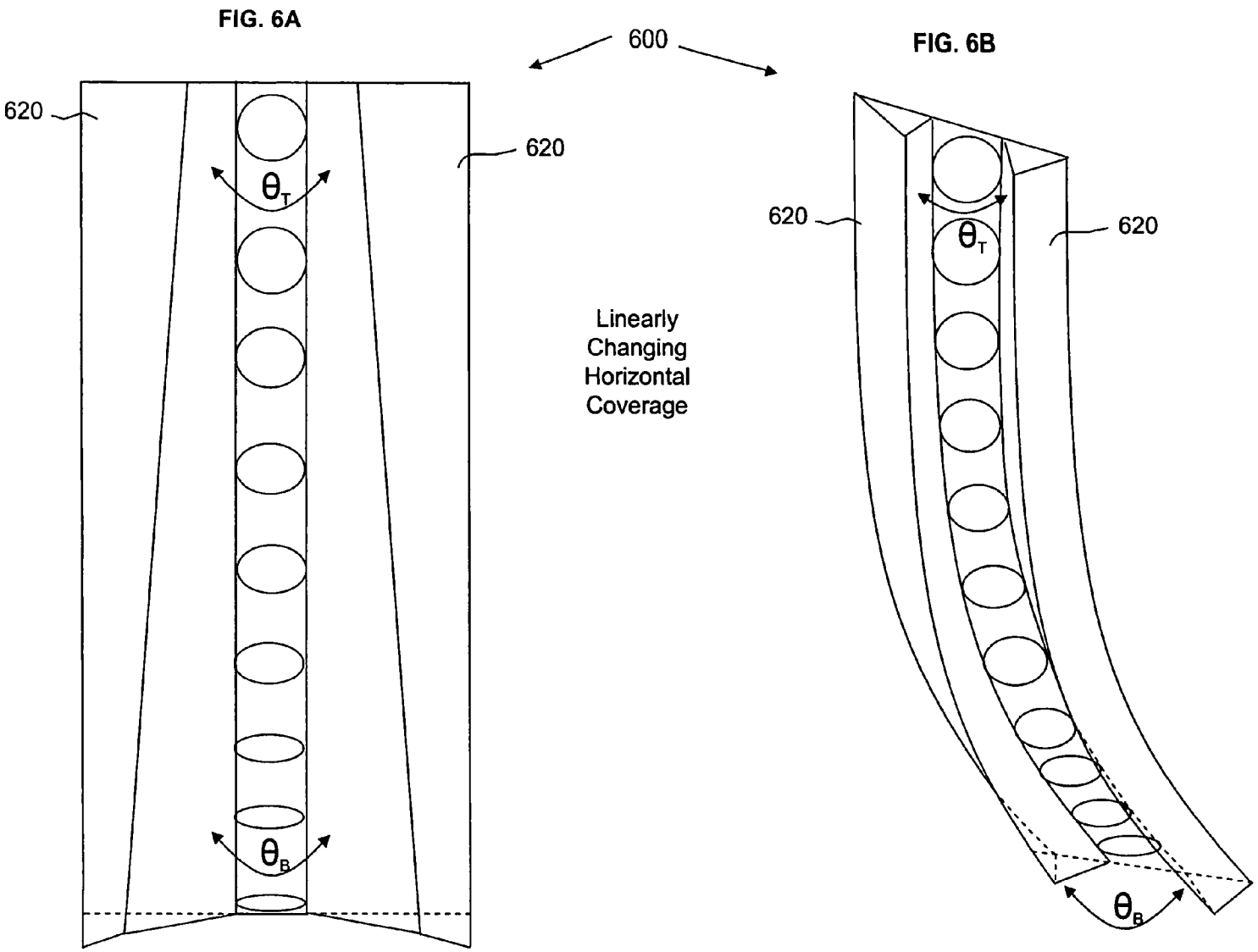
FIGS. 6A-6B depict one embodiment of a curved array loudspeaker having linearly changing horizontal coverage.
Figure 7:
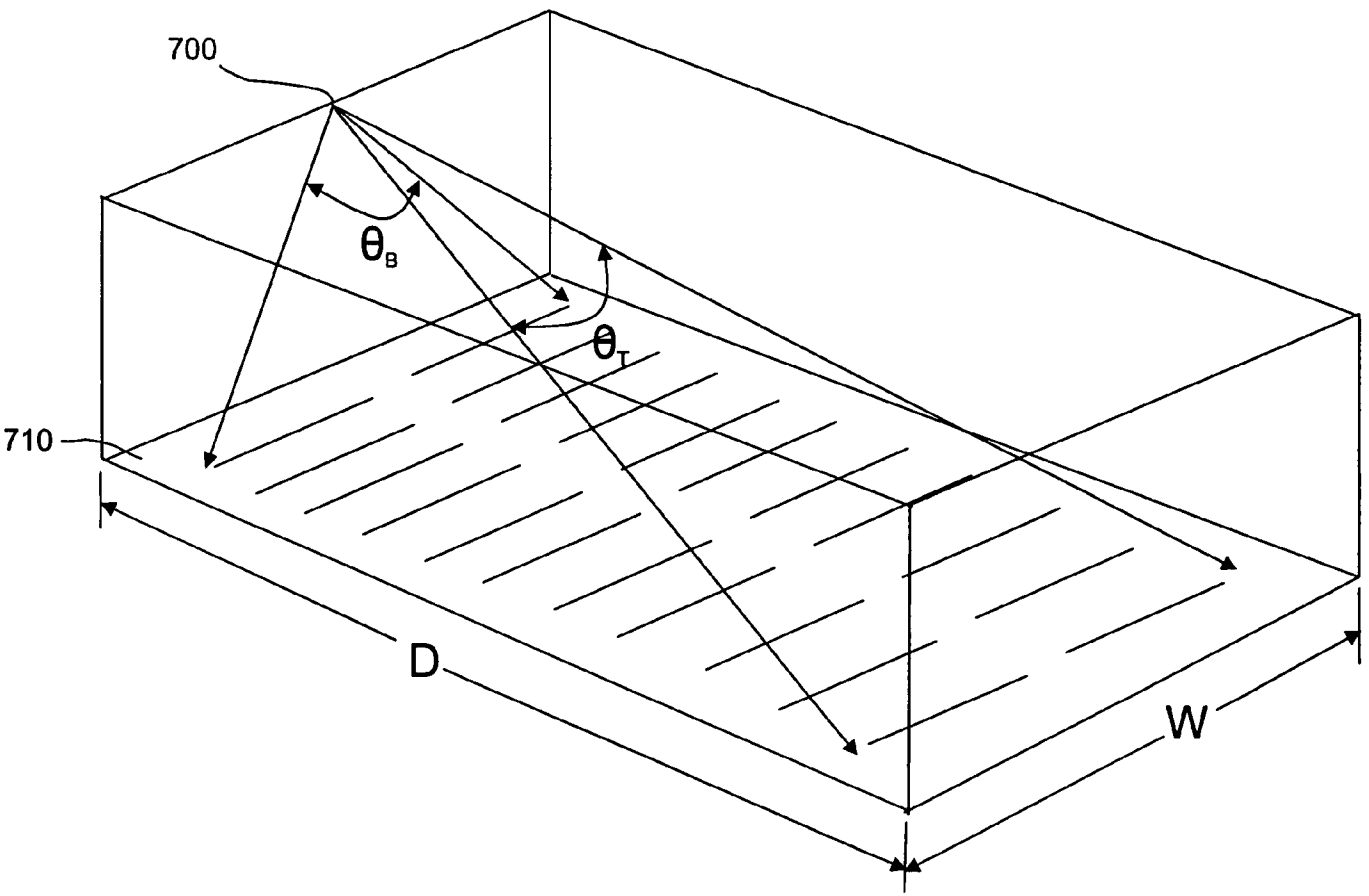
FIG. 7 is a simplified diagram showing the coverage of the embodiment of FIGS. 6A-6B.

Referring now to FIGS. 6A-6B, depict is another embodiment of a curved array loudspeaker 600 viewed from the front, in the case of FIG. 6A, and from a perspective view, in the case of FIG. 6B. As with FIGS. 5A-5B, the loudspeaker 600 may be comprised of a spiral array or an arcuate array. However, in the embodiment of FIGS. 6A-6B, loudspeaker 600 has a linearly changing horizontal coverage. That is, the angle $\theta_T$ near the top portion of the array is less than the angle $\theta_B$ toward the bottom portion of the array. In one embodiment, angle $\theta_T$ is approximately 60 degrees, but may vary from about 40 degrees to about 80 degrees. In another embodiment, or in addition to the previous embodiment, angle $\theta_B$ is approximately 120 degrees, but may vary from about 75 degrees to about 140 degrees. In this fashion, the spiral array loudspeaker 600 may be used to provide sound coverage for a specified area. For example, FIG. 7 depicts one embodiment of a sound source 700 (e.g., curved array loudspeaker 600) that is to provide sound coverage to the area 710—defined by distance D and width W. Since the top portion of the array provides coverage to the rear portion of area 710, the waveguide angle $\theta_T$ is smaller relative to the waveguide angle $\theta_B$, as shown in FIG. 7. Linearly varying the waveguide angle θ along the length of the waveguide, as done in the embodiment of FIGS. 6A-6B, may be used to provide coverage to an essentially rectangular shaped area, such as area 710.

Figure 8:
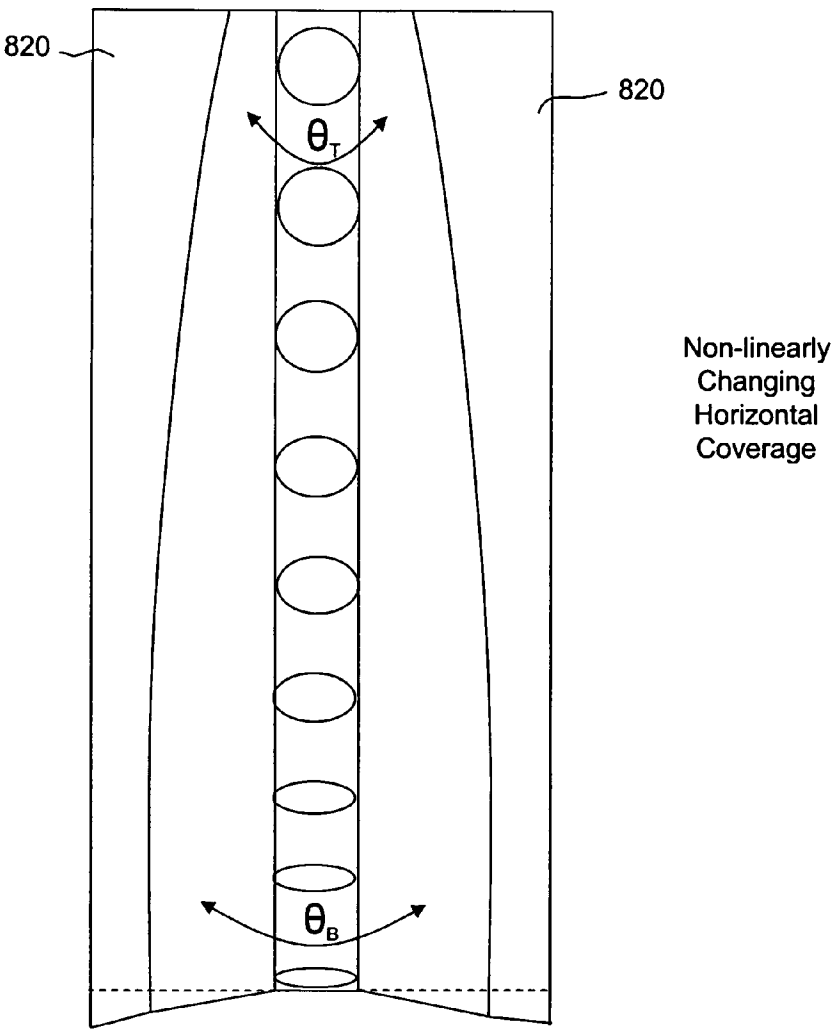
FIG. 8 depicts one embodiment of a curved array loudspeaker having non-linearly changing horizontal coverage.

FIG. 8 depicts another embodiment (viewed from the front) of a curved array loudspeaker 800 with a changing horizontal coverage provided by waveguide 820. In this embodiment, however, the waveguide angle changes in a non-linear fashion along the length of the array. That is, the angle $\theta_T$ near the top portion of the array varies as you move down the array in a non-linear fashion until the angle equals $\theta_B$. This non-linear variation of the waveguide angle along the length of the waveguide may be done to provide coverage to target areas of varying shapes (e.g., oval, circular, parabolic, etc). Again, the curved array loudspeaker 400 may be comprised of a spiral array or any curved array.

Figure 9:
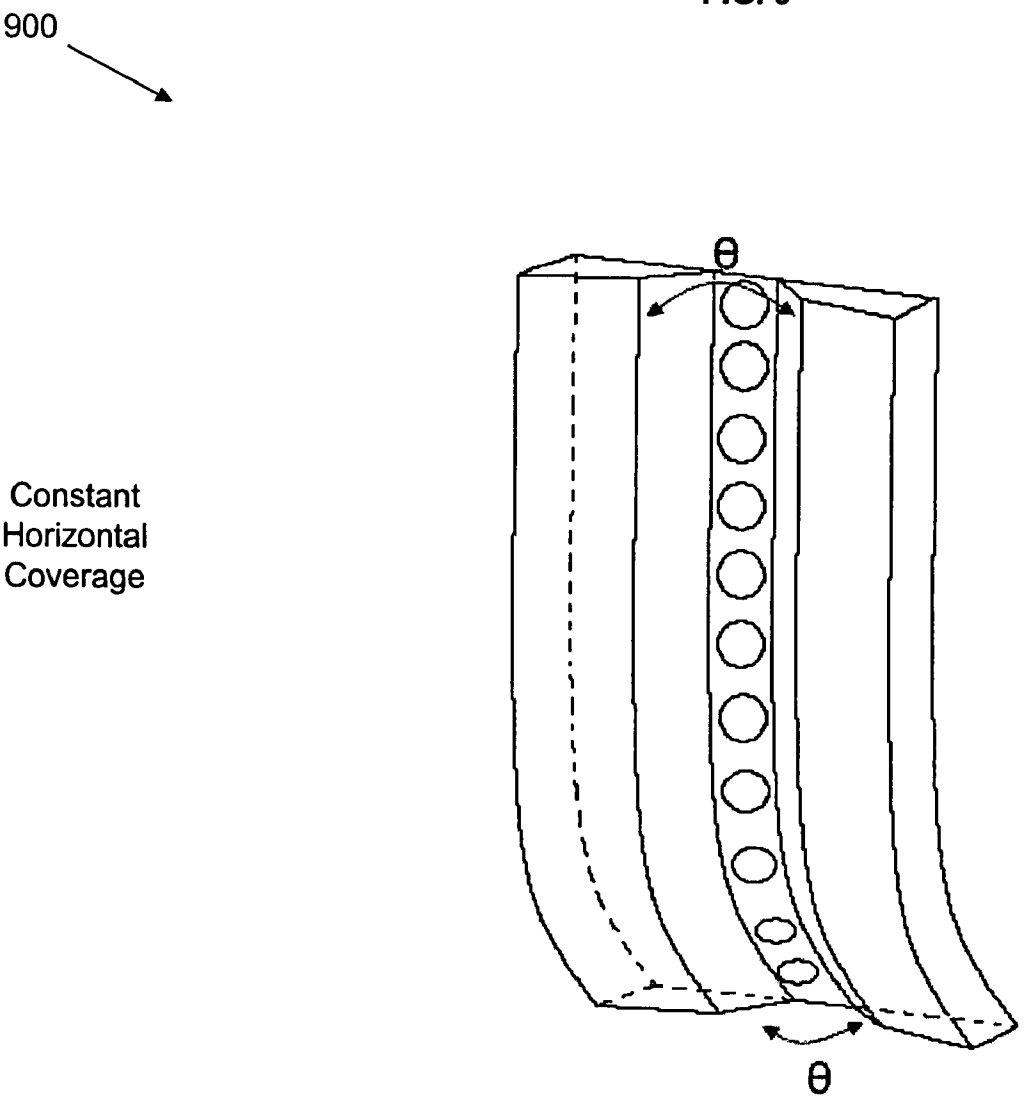
FIG. 9 is a perspective view of another embodiment of a curved array loudspeaker having a constant horizontal coverage.
Figure 10:
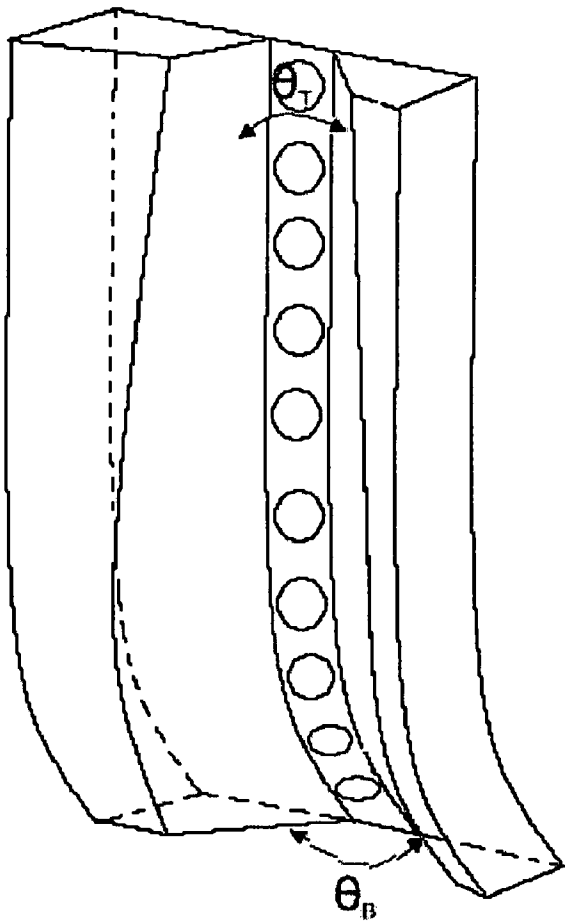
FIG. 10 is a perspective view of another embodiment of a curved array loudspeaker having a changing horizontal coverage.

Referring now to FIG. 9, depicted is one embodiment of a perspective view of a curved array loudspeaker. As with FIGS. 5A-5B, loudspeaker 900 includes a constant waveguide horizontal angle θ that provides a constant horizontal coverage along the length of the array. In contrast, the loudspeaker 1000 of FIG. 10 provides a linearly changing horizontal coverage by having a waveguide angle $\theta_T$ near the top portion of the array that is smaller than the angle $\theta_B$ toward the bottom portion of the array. In one embodiment, angle $\theta_T$ is approximately 60 degrees, but may vary from about 40 degrees to about 80 degrees. In another embodiment, or in addition to the previous embodiment, angle $\theta_B$ is approximately 120 degrees, but may vary from about 75 degrees to about 140 degrees.

Figures 11A, 11B:
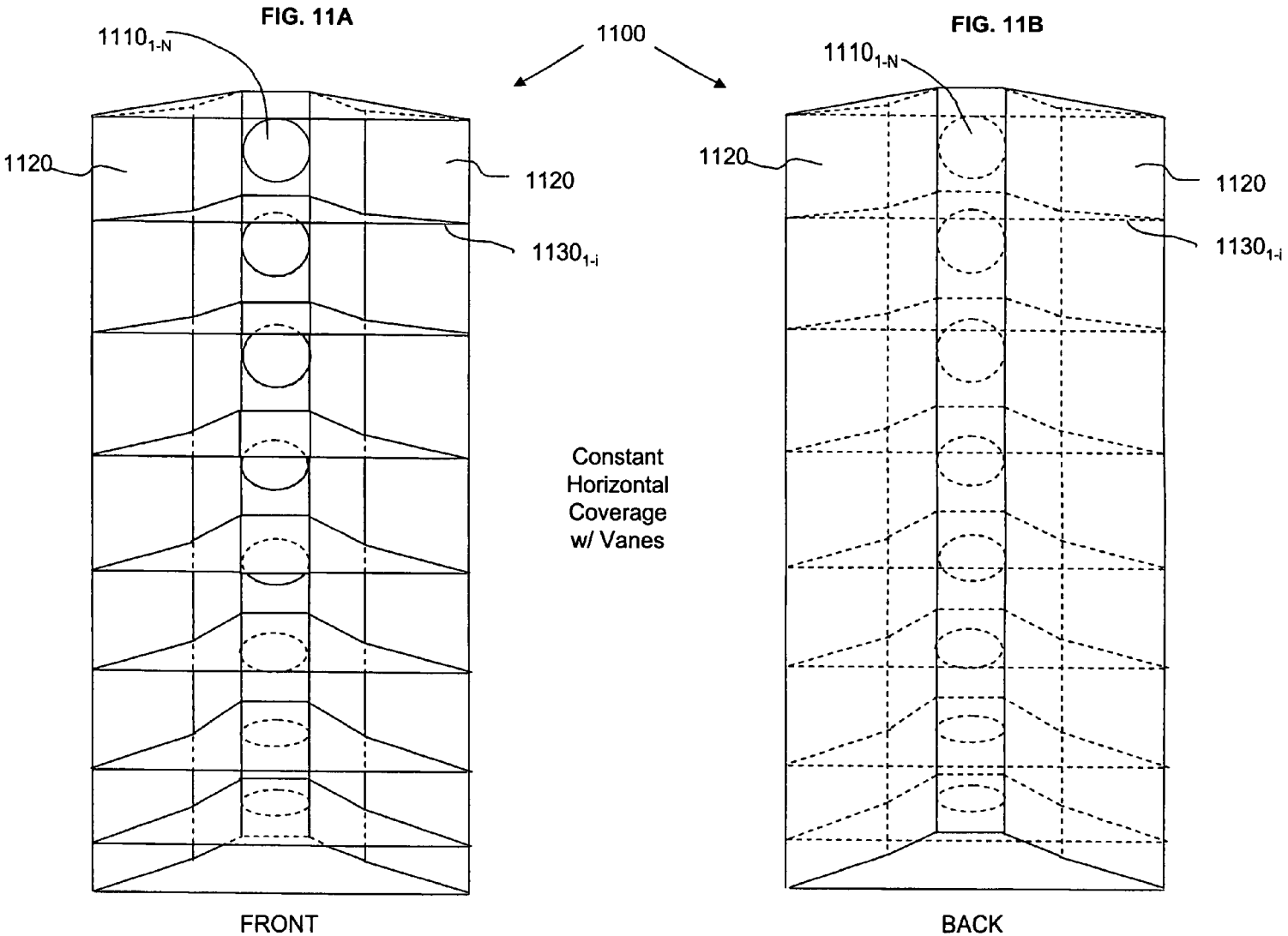
FIGS. 11A-11B depict front and back views of one embodiment of a curved array loudspeaker having a constant horizontal coverage and segmented by a plurality of acoustic vanes.

FIGS. 11A-11B depict one embodiment of a curved array loudspeaker 1100 having a constant horizontal coverage along the length of the array. While in one embodiment, the loudspeaker 1100 may be comprised of a spiral array, in another embodiment the loudspeaker 1100 may be comprised of an arcuate array. FIG. 11A depicts a front view of the loudspeaker 1100 with N drivers $\mathbf{1110}_{1\text{-}N}$ running along the length of the loudspeaker 1100, whereas FIG. 11B depicts the loudspeaker 1100 from a rear view. In addition, loudspeaker 1100 is designed with a plurality of vanes $\mathbf{1130}_{1\text{-}i}$ interspersed between the drivers $\mathbf{1110}_{1\text{-}N}$. In one embodiment, vanes may serve to separate portions of the waveguide to assist in guiding the sound path. Moreover, as with the previously-described FIGS. 5A-5B, the waveguide 1120 of FIGS. 11A-11B is adapted to provide a constant horizontal coverage by having a constant angle between the left and right sides of the waveguide 1120 along the length of the array.

Figures 12A, 12B:
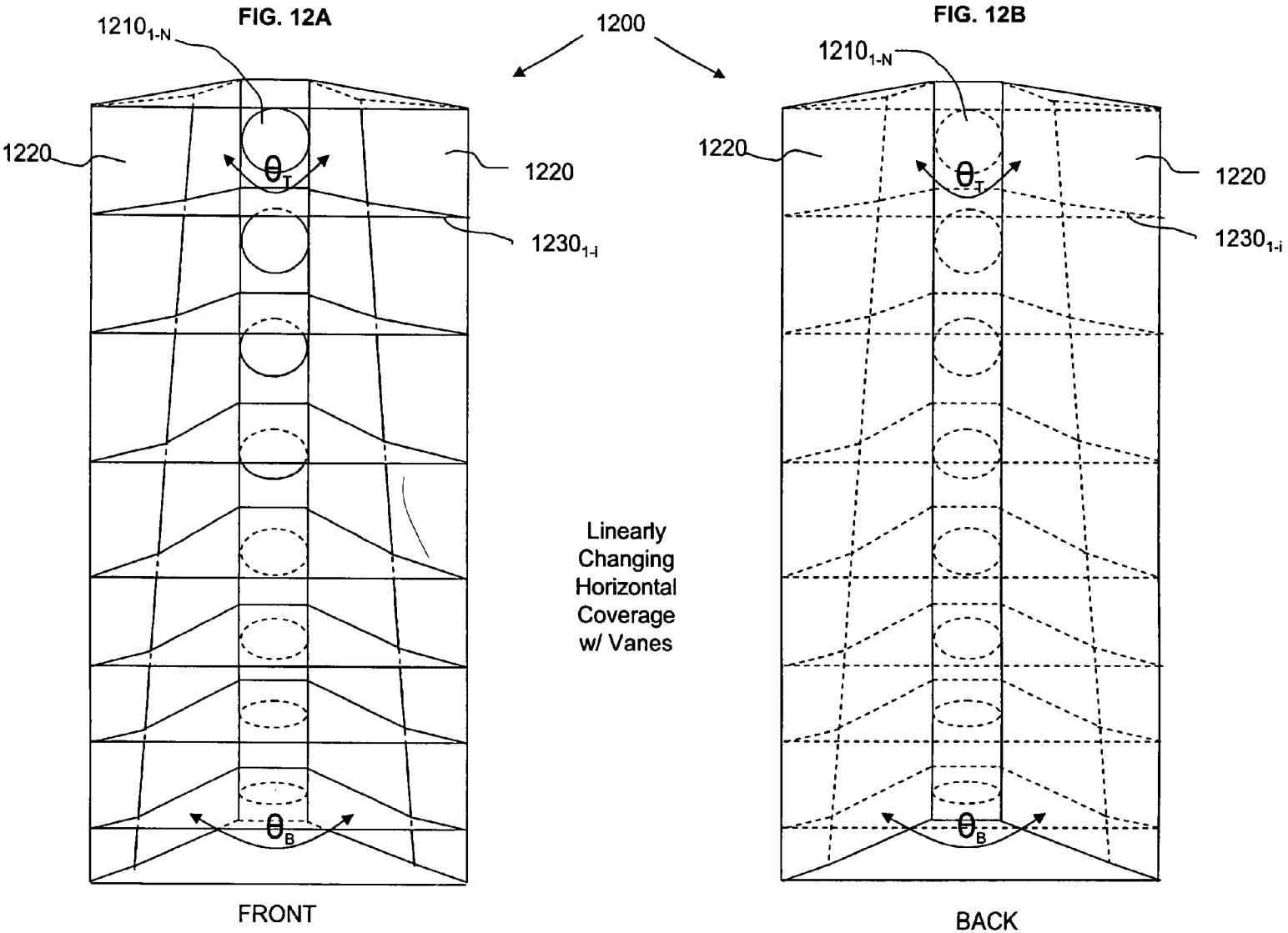
FIGS. 12A-12B depict front and back views of another embodiment of a curved array loudspeaker having a linearly changing horizontal coverage and segmented by a plurality of acoustic vanes.

FIGS. 12A-12B, in turn, depict another embodiment of a curved array loudspeaker 1200 viewed from the front, in the case of FIG. 12A, and from the back, in the case of FIG. 12B. As with previously-described embodiments, the loudspeaker 1200 array may be comprised of a spiral array or an arcuate array. However, in the embodiment of FIGS. 12A-12B, loudspeaker 1200 has a linearly changing horizontal coverage. That is, the angle $\theta_T$ near the top portion of the array is less than the angle $\theta_B$ toward the bottom portion of the array. As previously mentioned, varying the waveguide horizontal angle along the length of the waveguide may be used to provide coverage to a predefined coverage area. In addition, loudspeaker 1200 is designed with a plurality of vanes $\mathbf{830}_{1\text{-}i}$ interspersed between the drivers $\mathbf{1210}_{1\text{-}N}$.

Figure 13:
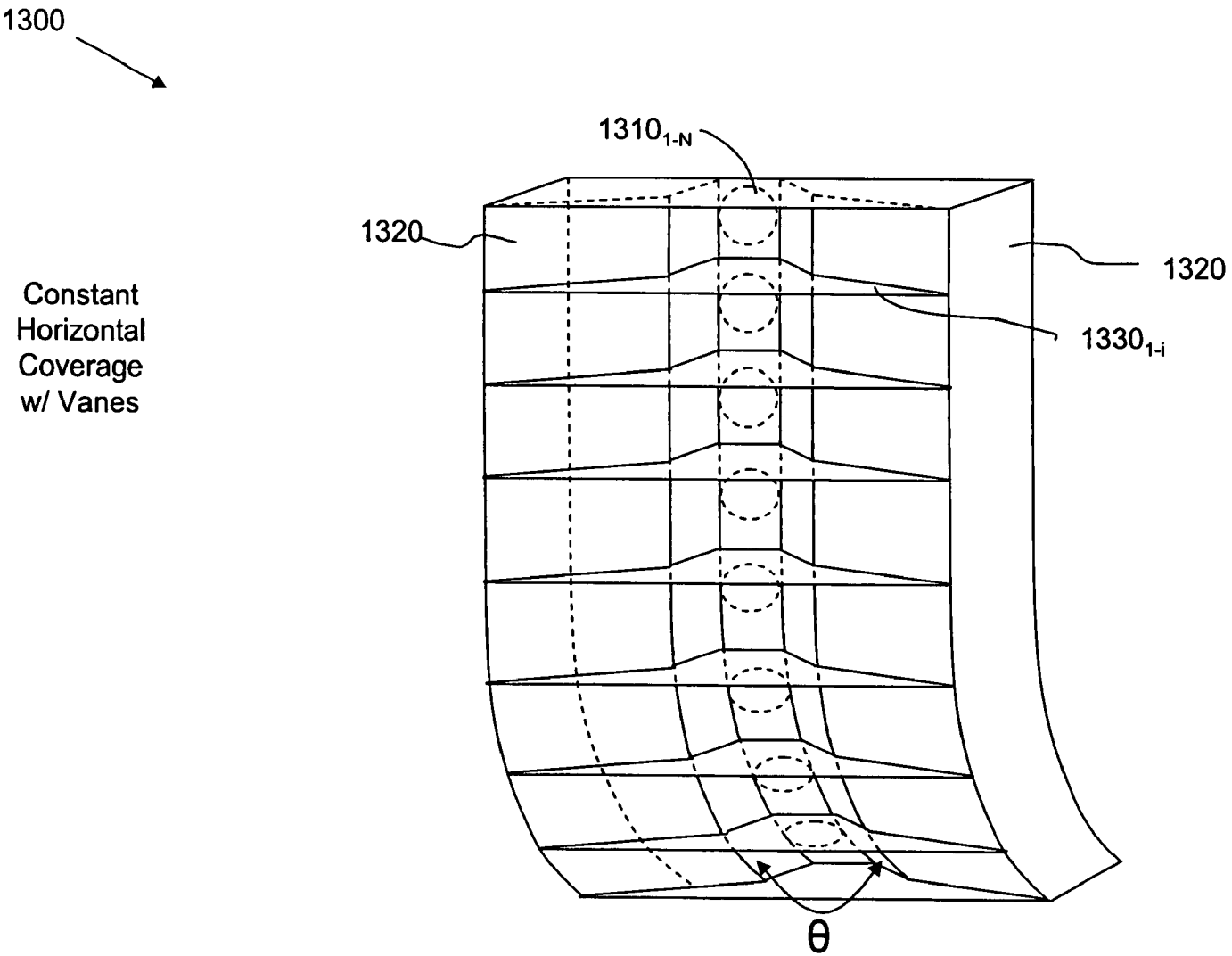
FIG. 13 is a perspective view of another embodiment of a curved array loudspeaker having a constant horizontal coverage and segmented by a plurality of acoustic vanes.

Referring finally to FIG. 13, depicted is another embodiment of a perspective view of a curved array loudspeaker designed with a plurality of vanes $\mathbf{1330}_{1\text{-}i}$ interspersed between the drivers $\mathbf{1310}_{1\text{-}N}$. In. In this embodiment, loudspeaker array 1300 includes a constant waveguide horizontal angle θ that provides a constant horizontal coverage by having a constant angle between the left and right sides of the waveguide 1320 along the length of the array.

Figure 14A:
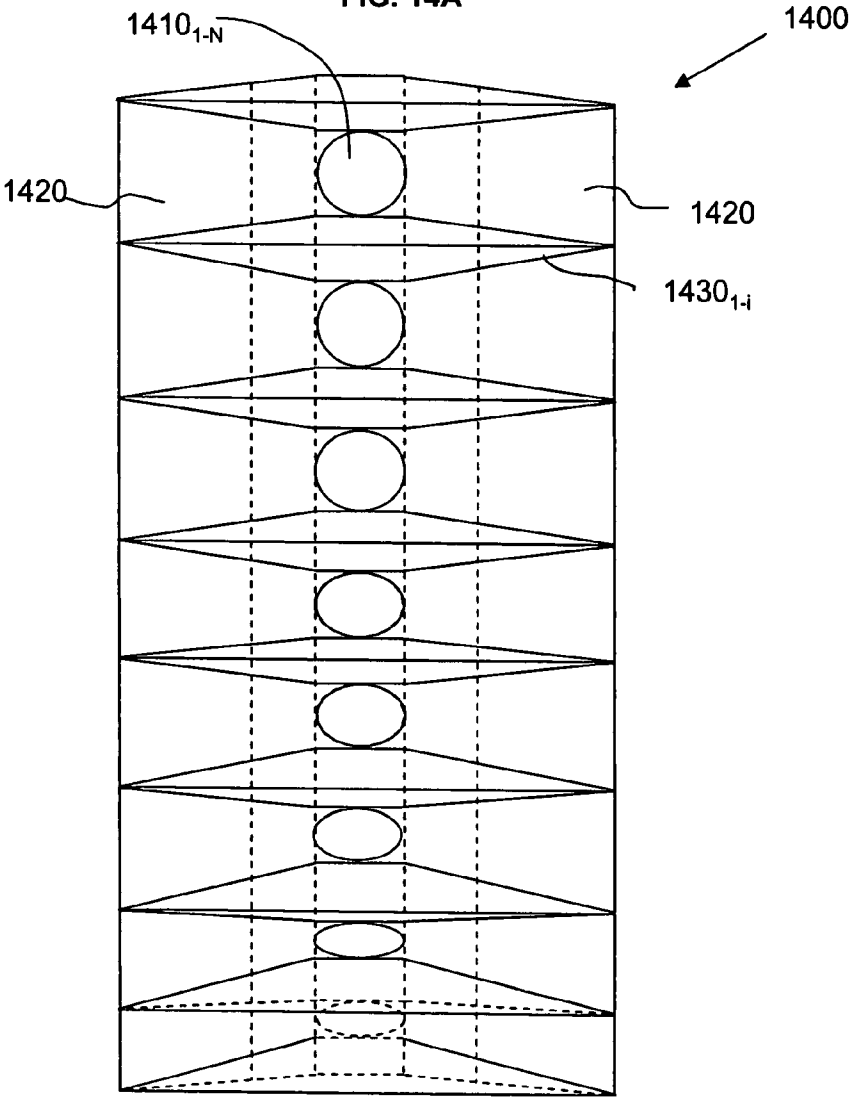

FIGS. 14A-14B depict a curved array 1400 consistent with one embodiment of the invention in which a plurality of phase plugs $\mathbf{1430}_{1\text{-}i}$ are used to help equalize sound path lengths from the drivers $\mathbf{1410}_{1\text{-}N}$ inlets to the waveguide mouth. Moreover, in the embodiment of FIGS. 14A-14B, the plurality of phase plugs $\mathbf{1430}_{1\text{-}i}$ are depicted as being essentially prismatic frustum wedge segments extending outward from the driver mounting surface (e.g., the surface to which drivers $\mathbf{1410}_{1\text{-}N}$ are mounted) to a point no further than the mouth of the waveguide 1420, as shown in FIG. 14B, for example. In one embodiment, the plurality of phase plugs $\mathbf{1430}_{1\text{-}i}$ may be used to maintain a constant phase between adjacent drivers at the mouth of the waveguide. As shown in FIG. 14A, phase plugs $\mathbf{1430}_{1\text{-}i}$ span from the bottom of a higher adjacent driver $\mathbf{1410}_{1\text{-}N}$ to the top of a lower adjacent driver $\mathbf{1410}_{1\text{-}N}$. However, it should equally be appreciated that the phase plugs $\mathbf{1430}_{1\text{-}i}$ may be narrower than the gap between drivers $\mathbf{1410}_{1\text{-}N}$. FIG. 14B, which depicts a cross section view of the curved array, depicts one embodiment of how the drivers $\mathbf{1410}_{1\text{-}N}$ and phase plugs $\mathbf{1430}_{1\text{-}i}$ may be oriented relative to one another.

While the invention has been described in connection with various embodiments, it will be understood that the invention is capable of further modification. This application is intended to cover any variations, uses or adaptations of the invention following, in general, the principles of the invention, and including such departures from the present disclosure as, within the known and customary practice within the art to which the invention pertains.

What is claimed is:

1. A loudspeaker comprising:

a plurality of electro-acoustical drivers each having a radiating axis to generate sound over a range of frequencies, wherein said plurality of electro-acoustical drivers are disposed in a geometric spiral with successive increases in angular displacement between said radiating axes forming a spiral line array; and a waveguide acoustically coupled to said plurality of electro-acoustical drivers, and further comprising intervals between each of said plurality of electro-acoustical drivers in which each of said intervals include a prismatic frustum wedge segment extending outward from a driver mounting surface to a point no further than a mouth of said waveguide to form a linear phase plug.

2. The loudspeaker of claim 1, wherein said waveguide is acoustically coupled directly to said plurality of electro-acoustical drivers without a throat section being interspersed there between.

3. The loudspeaker of claim 1, wherein said plurality of electro-acoustical drivers are direct-radiating transducers.

4. The loudspeaker of claim 1, wherein lines normal to said spiral line array do not converge to a common point.

5. The loudspeaker of claim 1, wherein a horizontal coverage of said loudspeaker remains constant over the spiral line array.

6. The loudspeaker of claim 1, wherein a horizontal coverage of said loudspeaker varies linearly over a length of the spiral line array, with said horizontal coverage progressively widening towards a bottom of said spiral line array.

7. The loudspeaker of claim 1, wherein a horizontal coverage of said loudspeaker varies non-linearly over a length of the spiral line array, with said horizontal coverage progressively widening towards a bottom of said spiral line array.

8. The loudspeaker of claim 1, wherein a horizontal coverage of said loudspeaker remains constant over a length of said spiral line array, wherein said horizontal coverage is offset from a centerline of said spiral line array so as to bias coverage towards one of two horizontal directions.

9. The loudspeaker of claim 1, wherein a horizontal coverage of said loudspeaker varies linearly over a length of the spiral line array, with said horizontal coverage progressively widening towards a bottom of said spiral line array, and wherein said horizontal coverage is offset from a centerline of said spiral line array so as to bias coverage towards one of two horizontal directions.

10. The loudspeaker of claim 1, wherein a horizontal coverage of said loudspeaker varies non-linearly over a length of the spiral line array, with said horizontal coverage progressively widening towards a bottom of said spiral line array, and wherein said horizontal coverage is offset from a centerline of said spiral line array so as to bias coverage towards one of two horizontal directions.

11. The loudspeaker of claim 1, wherein pairs of said plurality of prismatic frustum wedge segments each separated by one of said plurality of electro-acoustical drivers define a plurality of waveguide subsections having an elliptical cross-section normal to an axis of sound propagation, said plurality of waveguide subsections forming said geometric spiral.

12. The loudspeaker of claim 1, further comprising intervals between each of said plurality of electro-acoustical drivers in which each of said intervals include an acoustical vane extending outward from a driver mounting surface to a point no further than a mouth of said waveguide.

13. A sound radiation system comprising:

a plurality of electro-acoustical transducers each having a radiating axis to generate sound over a range of frequencies, wherein said plurality of electro-acoustical drivers are disposed in a geometric spiral with successive increases in angular displacement between said radiating axes forming a spiral line array; and a waveguide acoustically coupled to said plurality of electro-acoustical drivers, and wherein said plurality of electro-acoustical transducers are further interspersed by intervals each of which includes a prismatic frustum wedge segment extending outward from a driver mounting surface towards a mouth of said waveguide.

14. The sound radiation system of claim 13, wherein said waveguide is acoustically coupled directly to said plurality of electro-acoustical drivers without a throat section disposed there between.

15. The sound radiation system of claim 13, wherein said plurality of electro-acoustical transducers are direct-radiating transducers.

16. The sound radiation system of claim 13, wherein lines normal to said spiral line array do not converge to a common point.

17. The sound radiation system of claim 13, wherein a horizontal coverage of said system remains constant over the spiral line array.

18. The sound radiation system of claim 13, wherein a horizontal coverage of said system varies over a length of the spiral line array, with said horizontal coverage progressively widening towards a bottom of said spiral line array.

19. The sound radiation system of claim 13, wherein a horizontal coverage of said system remains constant over a length of said spiral line array, and wherein said horizontal coverage is offset from a centerline of said spiral line array so as to bias coverage towards one of two horizontal directions.

20. The sound radiation system of claim 13, wherein a horizontal coverage of said system varies over a length of the spiral line array, with said horizontal coverage progressively widening towards a bottom of said spiral line array, and wherein said horizontal coverage is offset from a centerline of said spiral line array so as to bias coverage towards one of two horizontal directions.

21. The sound radiation system of claim 13, wherein pairs of said plurality of prismatic frustum wedge segments each separated by one of said plurality of electro-acoustical transducers define a plurality of waveguide subsections having an elliptical cross-section normal to an axis of sound propagation, said plurality of waveguide subsections forming said geometric spiral.

22. The sound radiation system of claim 13, wherein said plurality of electro-acoustical transducers are interspersed by acoustical vanes extending outward from a driver mounting surface towards a mouth of said waveguide.

23. The sound radiation system of claim 13, wherein said plurality of electro-acoustical transducers are disposed within a single loudspeaker cabinet.

24. A waveguide system comprising a waveguide acoustically coupled to a plurality of electro-acoustical drivers each having a radiating axis to generate sound over a range of frequencies, wherein said plurality of electro-acoustical drivers are disposed in a geometric spiral with successive increases in angular displacement between said radiating axes forming a spiral line array, and further comprising intervals between each of said plurality of electro-acoustical drivers in which each of said intervals include a prismatic frustum wedge segment extending outward from a driver mounting surface to a point no further than a mouth of said waveguide to form a linear phase plug.

25. The waveguide system of claim 24, wherein said plurality of electro-acoustical drivers are acoustically coupled directly to said plurality of electro-acoustical drivers without a throat section being dispersed there between.

26. The waveguide system of claim 24, wherein a horizontal coverage of said system varies over a length of the spiral line array, with said horizontal coverage progressively widening towards a bottom of said spiral line array.

27. The waveguide system of claim 24, wherein a horizontal coverage of said system remains constant over a length of said spiral line array, wherein said horizontal coverage is offset from a centerline of said spiral line array so as to bias coverage towards one of two horizontal directions.

28. The waveguide system of claim 24, wherein a horizontal coverage of said system varies over a length of the spiral line array, with said horizontal coverage progressively widening towards a bottom of said spiral line array, and wherein said horizontal coverage is offset from a centerline of said spiral line array so as to bias coverage towards one of two horizontal directions.

29. The waveguide system of claim 24, wherein pairs of said plurality of prismatic frustum wedge segments each separated by one of said plurality of electro-acoustical drivers define a plurality of waveguide subsections having an elliptical cross-section normal to an axis of sound propagation, said plurality of waveguide subsections forming said geometric spiral.

30. The waveguide system of claim 24, further comprising intervals between each of said plurality of electro-acoustical drivers in which each of said intervals include an acoustical vane extending outward from a driver mounting surface to a point no further than a mouth of said waveguide.

31. The sound radiation system of claim 24, wherein said plurality of electro-acoustical transducers are disposed within a single cabinet.

* * * * *